US005108275A

United States Patent [19]

Sager

[11] Patent Number: 5,108,275

[45] Date of Patent: Apr. 28, 1992

[54] ROTARY PUMP HAVING HELICAL GEAR TEETH WITH A SMALL ANGLE OF WRAP

[76] Inventor: William F. Sager, 1552 John Anderson Dr., Ormond Beach, Fla. 32074

[21] Appl. No.: 628,837

[22] Filed: Dec. 17, 1990

[51] Int. Cl.[5] ..... F04C 2/16

[52] U.S. Cl. ..... 418/201.3; 418/171; 418/196; 418/203; 418/206; 418/150

[58] Field of Search ..... 418/165, 166, 171, 196, 418/201.2, 201.2, 201.3, 203, 206, 150

[56] References Cited

U.S. PATENT DOCUMENTS

| | | | |
|---|---|---|---|
| Re. 2,369 | 10/1866 | Roots . | |
| 892,295 | 6/1908 | Nütz | 418/171 |
| 1,459,552 | 6/1923 | Rathman | 418/201.1 |
| 1,866,026 | 7/1932 | Gerken . | |
| 2,159,744 | 5/1939 | Maglott | 418/201.3 |
| 2,256,743 | 9/1941 | Kleckner | 418/201.1 |
| 2,263,144 | 11/1941 | Scott | 103/203 |
| 2,363,343 | 11/1944 | Lindgren | 103/203 |
| 2,481,527 | 9/1949 | Nilsson | 418/201.3 |
| 2,685,257 | 3/1954 | Goldschmidt | 103/156 |
| 2,812,721 | 11/1957 | Coberly | 103/203 |
| 2,982,221 | 5/1961 | Whitfield | 418/202 |
| 3,046,904 | 7/1962 | Crow | 103/155 |
| 3,136,256 | 6/1964 | Chenault | 103/46 |
| 3,164,099 | 1/1965 | Iyoi | 418/201.3 |
| 3,926,540 | 12/1975 | Grenier | 418/197 |
| 3,986,801 | 10/1976 | Garland | 418/201.3 |
| 4,221,551 | 9/1980 | Rupert | 417/511 |
| 4,375,946 | 3/1983 | Page, Jr. | 417/566 |
| 4,548,562 | 10/1985 | Hughson | 418/201.3 |
| 4,662,831 | 5/1987 | Bennett | 417/430 |

FOREIGN PATENT DOCUMENTS

| | | | |
|---|---|---|---|
| 55-46077 | 3/1980 | Japan | 418/171 |
| 2-95789 | 4/1990 | Japan | 418/201.3 |

OTHER PUBLICATIONS

*Design of Machine Elements*, 5th ed., Spotts, M. F., (Prentice Hall, Englewood Cliffs, N.J.) 1978, pp. 503–511.

*Primary Examiner*—Richard A. Bertsch
*Assistant Examiner*—David L. Cavanaugh
*Attorney, Agent, or Firm*—Gerstman & Ellis, Ltd.

[57] ABSTRACT

A rotary pump comprises a housing and at least a pair of rotatable, meshing gears positioned within the housing. The meshing gears define teeth which extend helically in the general direction of the axis of each gear rotation. A flow inlet and a flow outlet are positioned in the housing to permit fluid to flow longitudinally along the gears generally in the direction of said axis as the gears rotate relative to each other. By this invention, the helically extending teeth define on at least one of the gears a total angle of wrap from end-to-end of the gear upon which they are carried of essentially 360 divided by twice the number of teeth on the gear, in degrees, multiplied by a number N of ½ to 3. This relatively low total angle of wrap provides significant improvements in gear pumps.

22 Claims, 5 Drawing Sheets

ROTARY PUMP HAVING HELICAL GEAR TEETH WITH A SMALL ANGLE OF WRAP

BACKGROUND OF THE INVENTION

Rotary pumps of the meshing gear type are well known for desired, volumetric pumping. They comprise a pair of meshing gears in a housing, so that the rotating gears pump fluid around their outer peripheries transversely across the gears, while pumping little or no fluid back in the other direction through the meshing gears. The term "gear" is intended to include any rotary structure having projections or teeth which meet with other projections of another rotary member to provide gear pump-like action.

In Garland U.S. Pat. No. 3,986,801 a gear-type rotary pump is shown in which the gear teeth are helically arranged on the gear and mesh with similarly helically arranged teeth on a second gear. In such a circumstance, a gear pump is provided which can pump fluids from end to end of the gear rather than transversely across the gear. However, upon analysis of the disclosure of the Garland patent, it becomes apparent that the pump exhibits a substantial amount of back leakage so that its operation is rather inefficient and non-volumetric. One reason for this comes from the fact that the helically arranged teeth of the pump disclosed in the Garland patent exhibit an overall degree of wrap within a range of 120 degrees to 270 degrees. This degree of wrap is the circumferential angle that each helical tooth passes through as it extends from one end to the other end of its gear.

Because of such a high degree of wrap, the helical gears, and the channels between them, cross and recross each other frequently, creating a labyrinth of connected, crossing spaces, which provide rearward "escape hatches" for fluid being pumped by the Garland device. Therefore, the pumping of the Garland device is rather inefficient.

Also in the Garland device there is no creation of completely closed channels defined completely between the engaged, rotating gears with their helically arranged teeth. Thus, the Garland device exhibits further disadvantages at ultra high pressures, since the outer casing which holds the rotating gears is always a part of the formed chambers that attempt to compress and pump fluids through the Garland device.

In accordance with this invention, an improved helical, toothed rotary pump is provided, which exhibits substantially less back leakage than the Garland-type pump, and which, in preferred embodiments, is capable of forming movable pumping chambers between intersecting helical teeth of the engaging gears, which chambers are entirely enclosed between the engaging teeth and essentially out of contact with the casing which surrounds the teeth. Thus, the pump of this invention, while usable for pumping liquids, gases, and creating vacuums, is particularly suitable for ultra high pressure pumping of gases or the like, since the casing of the pump does not have to be reinforced to withstand the ultra high pressures that can be generated in fluids passing through the pump of this invention, nor is the clearance between the case and the teeth subject to the ultra high pressure, with consequent leakage.

Additionally, the pump of this invention may be manufactured at lower cost and greater simplicity than the pump of Garland. The pump of this invention may be used as the basis for a new internal combustion engine, because of its capacity for ultra high compression, coupled with smooth, continuous operation and low back-leakage.

The pump of this invention operates by the creation, between helical teeth of opposite, meshing gears, a continuing series of chambers for fluid which are defined at the inlet end of the pump and travel down the gears in a helical path to the outlet end. Thus, fluid contained in the chambers is forcefully driven from the inlet end to the outlet end, with compression if the pump is operated in one direction, and with expansion if the pump is operated in the other direction of rotation, as in the situation where the pump is being used as an internal combustion engine. The pump exhibits low back leakage, resulting from an inherent, good sealing of the chambers that are continuously formed as the pump rotates.

DESCRIPTION OF THE INVENTION

In this invention a rotary pump comprises a housing and at least a pair of rotatable, meshing gears positioned within said housing. The meshing gears define teeth which extend helically in the general direction of the axis of each gear rotation. A flow inlet and a flow outlet are positioned in the housing to permit fluid to flow longitudinally along the gears, generally in the direction of said axes as said gears rotate relative to each other.

In accordance with this invention, the helically extending teeth on at least one of the gears define on at least one of the gears a total angle of wrap, from end to end of the gear upon which they are carried, of essentially 360 divided by twice the number of teeth on the gear, in degrees, multiplied by a number N between ½ and 3. This results in a total angle of wrap in the gears of this invention which is substantially less than that disclosed in the Garland patent cited above.

The total angle of wrap is the total angle that the gear teeth subtend about the gear in their total extension from end to end of the gear.

Because the total angle of wrap of the helically extending teeth is substantially less in this invention, there is less crossing of channels defined between the teeth of one gear over the channels defined on the other gear, so that the potential "escape hatches" for fluids trapped within such channels are greatly reduced. Thus, better sealing is provided in the pump of this invention, with improved isolation of each of the individual, sealed chambers which are continuously formed and which move longitudinally from the inlet toward the outlet of the pump as the pump rotates.

Typically, the number N described above is between 0.8 and 2. It is generally preferred for the number N to be approximately 1, so that the preferred total angle of wrap of the teeth from end to end along their gear is essentially 360 divided by twice the number of teeth on the gear in degrees. For example, for a gear having 100 teeth in accordance with this invention, the total angle of wrap is preferably 360/200 or 1.8 degrees. As stated above, this angle might be multiplied by a number between ½ and 3 to come up with an overall range for the total angle of wrap in that situation of 0.9 to 5.4 degrees. Thus it can be seen that the total angle of wrap of the teeth used in the pump of this invention can be very low. While such an angle may be close to being parallel to its gear axis, the functional difference created by such an angle is profound, as described herein.

The actual helical angle of the teeth about each gear, and the length of the gear, may vary in a relatively wide manner as long as they comply with the above-described total angle of wrap. However, it is generally preferred that the teeth define a helical angle to the gear axis of no more than about 20 degrees. Particularly, the teeth may define a helical angle or pitch of about $\pi$ D/2TL where $\pi$ is the known constant of 3.14159+, D is the diameter of the gear, T is the number of teeth, and L is the length of the gear, measured in the direction of the axis of rotation. The resulting figure is a ratio of the circumferential displacement of each gear tooth per unit of axial displacement of the gear tooth, from which, if desired, an angle of helical pitch may be calculated by taking the arctangent thereof. This specific angle of helical pitch may be varied if desired by multiplying by the same factor as recited above of ½ to 3, to provide a reasonable variation which can still give desirable results of this invention.

Particularly for the pumping of gases, it is generally preferred for each gear to carry from 40 to 1000 teeth. It has been discovered that gears made in accordance with this invention which contain at least about 40 teeth exhibit a new form of operation which is not found in corresponding gears with helical teeth that have an unduly high angle of wrap, nor in corresponding gears having substantially fewer than 40 teeth. Such gears in accordance with this invention define sealed chambers between the meshing teeth of the gears which are compressed as the respective gear teeth rotate toward a relation of squarely facing the other gear, in which the chamber becomes spontaneously sealed at both sides while still defining a diminishing volume. Thus, it becomes possible to provide ultra high compression to the fluid within said chamber. This principle of operation can be used to provide an ultra high compression pump, or it can be used as the basis for an internal combustion engine which operates on a smooth, continuous basis without reciprocating valves.

Additionally, because of the geometry provided by such gears under the conditions described above, the outer casing that holds the gears is not required to help define such transient compression chambers as described above, but rather the compression chambers are completely defined between the respective gears. Thus, a potentially serious technical problem which afflicted the Wankel rotary engine, for example, is eliminated, in that there is no need to provide a high temperature, high performance seal between the rotating members and the inner wall of the casing in order to obtain high compression in the chambers of the pump of this invention.

It is generally preferred for the pump of this invention, when it is intended for the pumping of gas or for use as an internal combustion engine, to have from about 100 to 500 teeth per gear in the circumstance when both gears are of the same size, and both gears have the same number of teeth. When the pump of this invention is intended for the pumping of liquid, it is generally preferred for the gears to typically each exhibit from 6 to 500 teeth per gear. As a vacuum pump, the pump of this invention can typically have gears that carry from 2 to 10 teeth per gear.

In another embodiment of this invention, the gear pump of this invention includes an outer ring gear defining teeth on its inner periphery. One or more inner gears are typically no more than about ⅓ the diameter of the outer gear and define teeth that are proportioned to mesh with the inwardly facing teeth of the outer gear. The teeth of the gears are helically angled as described above. The total angle of wrap of this invention is typically found in the larger gear, based on the number of teeth of the larger gear.

Accordingly, as the outer gear rotates, the inner gears rotate with it about a different but parallel axis of rotation. The meshing teeth of the respective gears provide the fluid-receiving chambers which may be essentially identical in shape and function to that which has been described above, for the pumping of fluids from one end of such a gear system to the other. An appropriate housing and a fluid inlet and outlet are thus provided to the system to provide a novel and different sort of gear pump.

For example, a large, outer ring gear may be provided, which contains a plurality of inner gears, for example 2 to 4 inner gears, which have teeth that engage the inner periphery of the outer ring gear. Each of the engagement areas of the inner gears with the outer ring gear may be provided with an inlet and an outlet manifold, so that a plurality of pumping flow paths are provided in a compact space. Such an arrangement is suitable for use as an internal combustion engine.

Because of the concave nature of the outer ring gear, the gears defined on its inner surface typically define channels between them which are slightly more than semicircular in cross-section. In some circumstances this shape may need to be modified by about 1 micron in 10,000 microns to facilitate the insertion of the teeth of the inner gears. This does not result in substantial leaking, particularly when the outer gear has at least 200 teeth. Also, the particular geometry of this type of pump can prolong the desired, independent chambers which are formed without recourse to the outer casing. This, in turn, can provide longer and better compression of fluids in such independent chambers.

Thus, when a sufficient number of teeth are provided to obtain the desired independently-sealed, moveable chambers between the respective gears, the advantage is obtained that the extreme pressures of the pump can be kept away from the casing, so that a moving, high performance seal against the casing is not required, the fluid pumping chamber thus formed being entirely enclosed by the gears and their teeth.

Additionally, the pump of this invention provides excellent sealing with a naturally formed multiple back-up seal provided by the teeth against the casing because of the low wrap angle used, and preferably a substantial number of teeth of, for example, 12 or more. Compressed fluids cannot leak back to a low compression area out of their moving chambers defined by the gear without passing across a plurality of seals defined by the pump teeth against the casing.

This principle can be used in conjunction with the independently formed chambers which do not involve the outer casing, since it provides sealing in addition to the independent chambers. Also, in embodiments where such independent chambers are not formed, improved sealing is provided in its own right as a consequence of the low overall total angle of wrap in accordance with this invention.

The fluid may be transported to the rotating gears through a manifold that leads to the respective axial ends of the gears. However, it is preferred in many circumstances to also provide a tapered side entry port for both entering fluid and exit fluid, with the tapering side entry port being widest at the respective entry and exit and narrowing down to a substantial point prior to reaching the other axial end of the gear. The entry port side manifolds thus formed are typically positioned in over the area where the gears mesh.

The exit port manifold is generally positioned on a side of the casing opposed to the entry port manifold. Also, the entry port side manifold may be used without the presence of an outlet port side manifold, and vice versa, if desired. Such manifolds provide improvements in the fluid flow into and out of the channels between the rotating gear teeth.

The rotary gear pump of this invention operates with preferably three compression stages, the third stage being produced in pumps as described above having at least about 40 teeth and designed in accordance with this invention.

Stage 1 compression is the transport of fluid in channels between gear teeth from the original intake zone of the manifold to a zone where the fluid merges with fluid in channels of the other pump gears, and where the beginnings of compression take place.

Stage 2 compression is produced by dynamic compression of the fluid within the channel regions between the outlet end of the casing and the location where the chambers become effectively sealed, as is preferred in accordance with this invention. That location depends in part upon the rotational velocity of the pump gears. The dynamic compression is due to the acceleration of fluid as the fluid path is being narrowed by the engagement of the gear teeth, with one gear tooth moving into channels of the other gear, thus both compressing and longitudinally moving the fluid which occupies such channel.

Finally, in the preferred embodiments of this invention, Stage 3 compression takes place in which a gear tooth enters into laterally sealing relation with the walls of its associated channel, with a sealed chamber being thus formed at the bottom of the channel by the gear tooth. Thus, the Stage 3 compression can provide a piston-like compression to very high pressures, as governed by the specific design of the pump and its speed of operation. As previously stated, the inlet end of such chambers becomes, in preferred structures of this invention, sealed from the inlet manifold as the gears rotate.

If desired, groups of engaging gears having helical teeth may be provided in the pump of this invention for multiple pumping action. For example, three gears in side-by-side relation can provide such multiple pumping action, with two pumping flow paths.

DESCRIPTION OF SPECIFIC EMBODIMENTS

Figure 1:
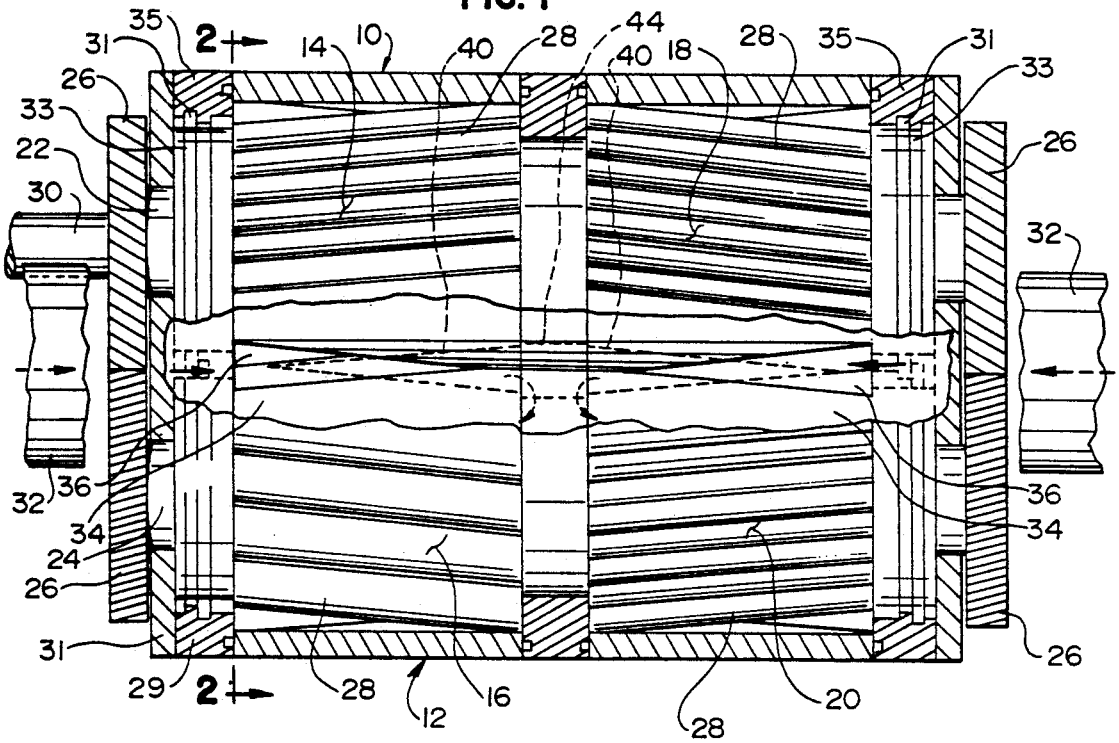
FIG. 1 is a bottom plan view, with portions broken away, showing a double rotary pump having engaging gears with helical gear teeth.
Figure 2:
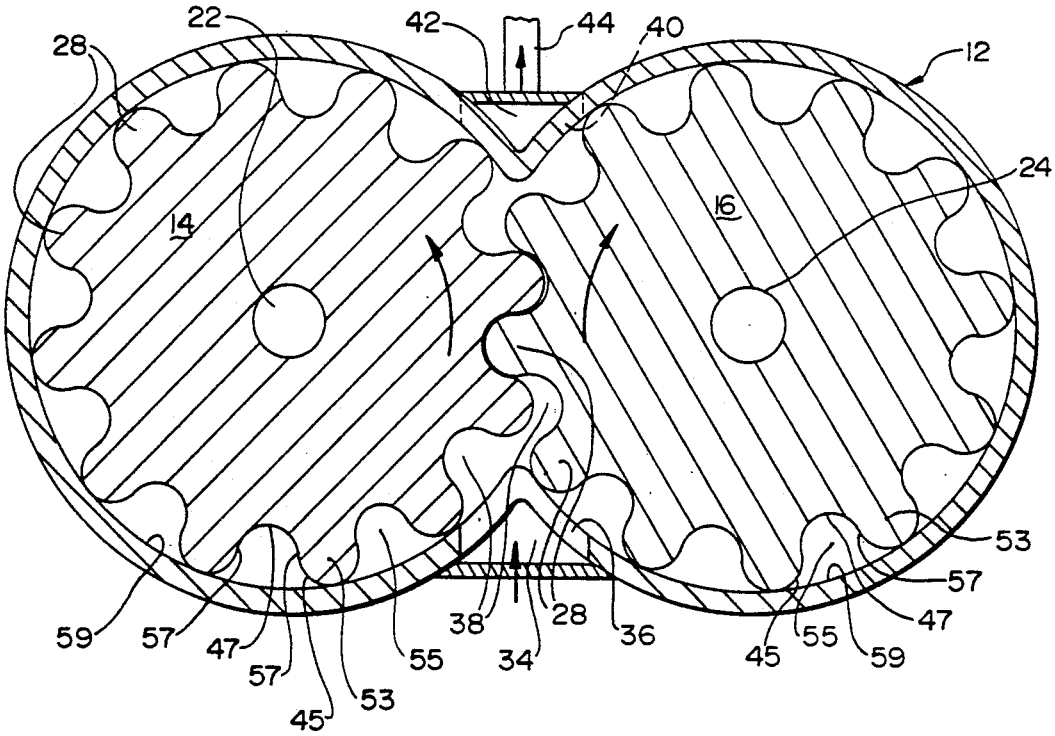
FIG. 2 is a sectional view taken along line 2—2 of FIG. 1.
Figure 3:
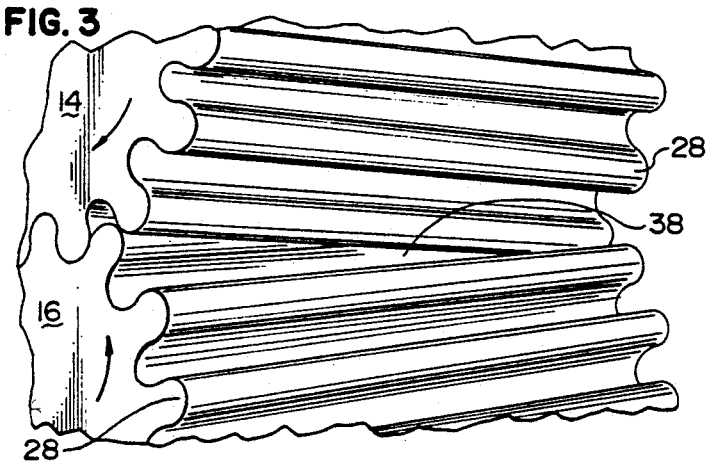
FIG. 3 is an enlarged, fragmentary, perspective view showing the intersection of the teeth of two of the gears of FIG. 1, showing how transient flow chambers are defined between the respective gear teeth.

Referring to FIGS. 1 through 3, a rotary pump 10 is disclosed, comprising a housing 12 and two pairs of rotatable, meshing gears 14, 16, 18, 20 positioned within the housing. Gears 14 and 18 may reside upon a common axle 22, and may respectively mesh with gears 16 and 20, which also reside upon a common axle 24. The rotational orientation of the meshing gears can be affixed by means of timing gears 26, or any other desired torque balancing system, which can take much of the rotational load off of the individual helically disposed teeth 28 of the respective gears 14, 16, 18, 20. Power may be applied to or taken off of the system by means of power shaft 30. In other words, the pump may be driven by power applied by shaft 30, or power may be transferred through shaft 30 from pressurized fluid that passes through the pump to rotate the respective gears. Labyrinth seals 31 may be provided at each end of the pump system, with gear end portions 33 rotating in sleeves 35.

When the pump of FIG. 1 is being used as a pump with power being applied to the shaft, fluid to be pumped enters the system through inlets 32, which communicate with inlet manifolds 34 on the outside of housing 12, each of which communicate through housing 12 through a tapered slot 36, each tapering away from inlet source 32. As shown in FIG. 2. Fluid entering through manifold slot 36 enters into a series of angled helical chambers 38 (FIG. 2) that are defined between the respective teeth 28 of gears 14, 16 (with the situation being identical for gears 18, 20). The angled channels 38 close at the inlet end as gears 14, 16, rotate, driving fluid trapped within channels or chambers 38 in a helical pattern which spirals generally about the axis of rotation of the gears.

At the downstream end of gears 14, 16 the pumped fluid passes laterally out of chambers 38 through angled slot 40 in the wall of housing 12, to enter into outlet manifold 42. From there, fluid can flow transversely outwardly of the system through a laterally extending outlet port 44.

The particular system shown in FIG. 1 is advantageous, in that certain unbalanced forces of pumping can be counterbalanced by the presence of the two pumps in opposed relation to each other.

The teeth 28 may each define an outer lobe 45 having a circular, outwardly-facing cross-section perpendicular to the axis of gear rotation. The teeth each define between them a recess 47 proportioned to receive a gear tooth from an adjacent meshing gear. The recess defines an inwardly-facing cross-section perpendicular to the axis of gear rotation which is circular. The gear housing defines an inner chamber 59 which is proportioned to sealingly engage the circular cross-sectioned, outer lobes 45 of the gear teeth as said gears rotate. The circular, outwardly facing cross-sections of the gear teeth each terminate at each end at angle lines 57 on the pitch surface between said meshing gears. The circular, outwardly facing cross-sections have origins 53 located on the pitch surface of the gears, which is the surface located half way between the outermost portion of each gear and the innermost portion thereof. The inwardly facing, circular cross-section 47 of each recess is of essentially equal radius to the outwardly-facing cross-sections 45 of the teeth on either side of the recess. The circular, inwardly-facing cross-sections also have origins 55 located on the pitch surface and terminating on each end at the angle lines 57.

The shape of teeth of gears having more than about 20 teeth per gear will typically be very similar to the above, but as the number of teeth increase the angle line becomes less and less angled, and thus can be essentially ignored in the manufacture of the gear when the number of teeth on the gear exceeds 20 or so.

In accordance with this invention, the helically extending teeth 28 each define a total angle of wrap from end to end of each respective gear 14, 16, 18, 20 upon Which they are carried of essentially 360 divided by twice the number of teeth on the gear, in degrees, with N being 1 in this embodiment. Thus, since each gear carries 12 teeth, the total angle of wrap is fifteen degrees. Also, the helical angle or pitch of the teeth ($\pi$ D/2TL) may be, for this system, about 7½ degrees when the diameter of the gear is six inches and the length of the gear is six inches.

Such a gear, having a low angle of wrap compared with helical gear pumps of the prior art, exhibits improved sealing characteristics resulting in less back leakage as the gear pump operates. Such a pump is particularly useful for the pumping of liquids, which of course have less capability for leakage through small spaces than gases.

Figure 5:
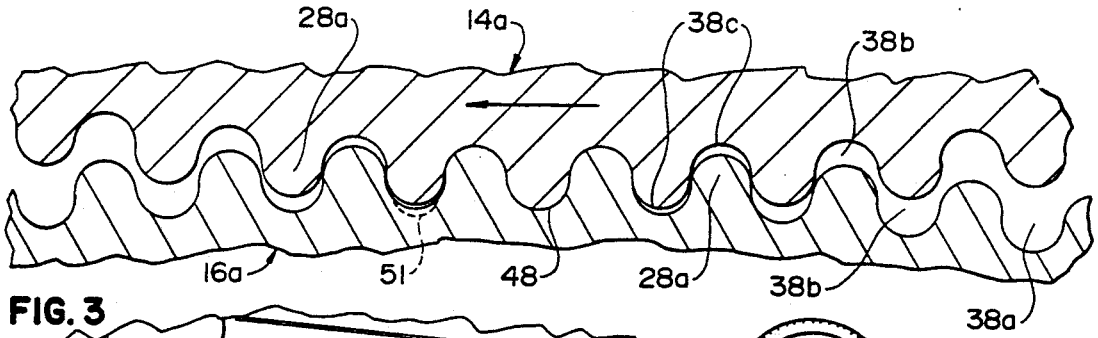
FIG. 5 is a fragmentary, enlarged, transverse sectional view of the meshing gears of FIG. 4 at their area of meshing.
Figure 4:
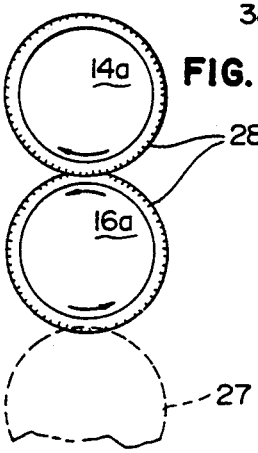
FIG. 4 is a schematic view of a rotary gear pump in accordance with this invention in which 100 helically extending gear teeth are defined on each gear.

Turning to FIGS. 4 and 5, another embodiment of the pump of this invention is disclosed, being similar to the pump of FIGS. 1 through 3, but in which respective engaging gears 14*a*, 16*a*, carry 100 helically disposed teeth 28*a*. As previously stated, the total angle of wrap of such teeth 28*a* is preferably only about 1.8 degrees. The actual angle of the teeth varies with the dimensions of the gear as previously described. However, a gear which is 12 inches in diameter and 6 inches long should have a ratio of circumferential displacement per unit of axial displacement of about 0.0314 as an optimum. Taking that as a tangent, one can obtain a desired helical angle for the gear teeth i.e. 1 degree, 48 minutes.

An optional third helical gear 27 is also shown to provide a second pumping channel of meshing, helical gear teeth.

With the arrangement, shown in FIG. 5 (100 teeth per gear), it is possible to achieve the desirable three stage compression that has been discusses above. For example, in area 38*a* (FIG. 5) of the channels between teeth 28*a* of FIG. 5, stage 1 compression is taking place i.e. the transport of fluid in the channels from the original intake zone of the manifold to the zone where the fluid is merging with the fluid in the channels of other pump gears.

Stage 2 compression is taking place in the areas of channels 38*b*, as shown in FIG. 5, where the teeth 28*a* are entering into the respective channels of the meeting gear, causing dynamic compression of the fluid and its longitudinal acceleration downstream through the respective channels between the gear.

Third stage compression can take place in channels 38*c*, where the gear teeth 28*a* have entered into laterally sealing relation with the walls of the associated channel to define independently sealed chambers 38*c*. It is in this area where a piston-like compression can take place of gases, for example, to very high pressures, corresponding to the pressures sufficient to ignite gasoline vapor in a diesel cylinder or the like. Also, third stage compression can uniquely provide a desired gas lubrication in high pressure devices of this invention, with a compressed gas cushion forming in front of the moving seals, so that less oil lubrication is required.

Then, channels or chambers 38*c* disappear with further rotation, with the gear teeth exactly meshing at area 48, with the contents of the chambers 38*c* having been pumped downstream to the outlet manifold. Alternatively, a small pocket 51 may be defined at the bottom of each recess between each of the teeth 28*a* to provide a residual minimum volume as illustrated in FIG. 5. This would be desireable if the pump is to be used as an internal combustion engine.

Figure 6:
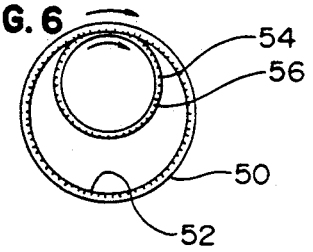
FIG. 6 discloses another embodiment of gear pump having helically disposed teeth in accordance with this invention.
Figure 7:
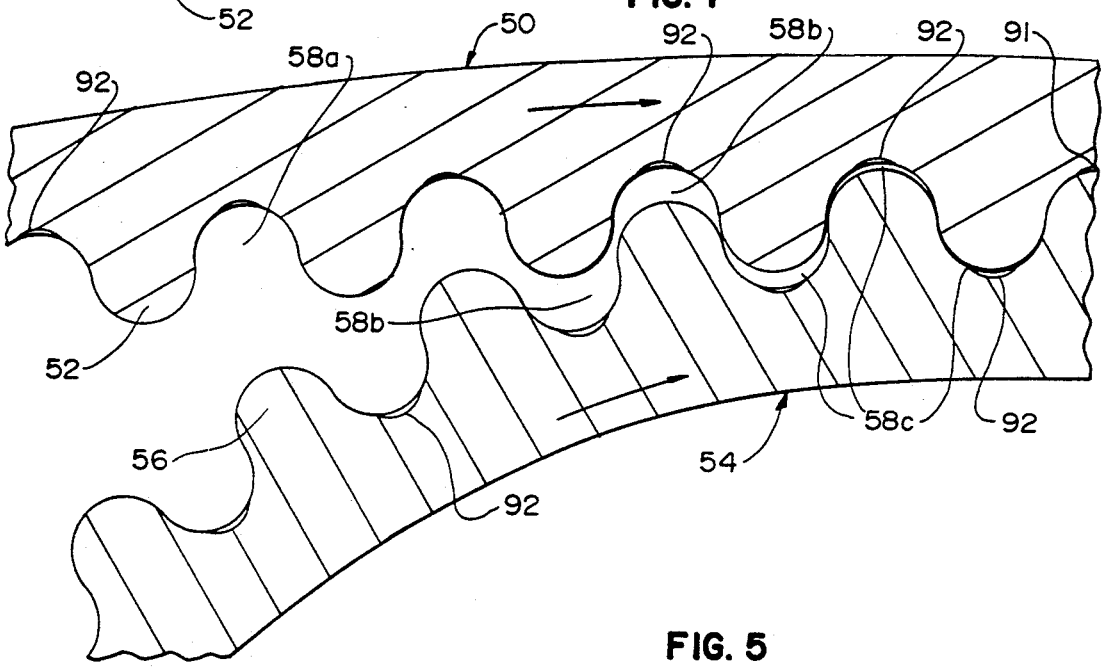
FIG. 7 is an enlarged, fragmentary, transverse, sectional view of the meshing gears adjacent their area of meshing.

Referring to FIGS. 6 and 7, another embodiment of helical toothed gear pump is disclosed. In this embodiment, as shown in FIG. 6, an outer ring gear 50 is provided, defining teeth 52 on its inner periphery. An inner gear 54 is provided, defining outwardly facing teeth 56 that are proportioned to mesh with the inwardly facing teeth 52 of the outer gear. Both gears are positioned to freely rotate with the gear teeth meshing with each other. The teeth of both gears are helically angled, with a total angle of wrap preferably in accordance with the formula described above, with the number of teeth being the number of teeth 52 in outer ring gear 50.

Thus, if outer ring gear 50 has one hundred teeth 52, the total angle of wrap may be, as before, about 1.8 degrees for outer ring gear 50, and the angle of teeth 56 of inner gear 54 will be at the same angle as teeth 52 so that proper meshing can take place, even though in such a circumstance the total angle of wrap of teeth 56 about gear 54 ma be higher than the total angle of wrap of teeth 52 in gear 50.

As in the embodiment of FIGS. 4 and 5, the three stages of compression are possible in the system of FIGS. 6 and 7 when outer ring gear 50 has one hundred or more teeth 52. As shown, the first stage of compression 58*a* gives way, as the gear rotates, to the second stage of compression 58*b*, where dynamic compression begins to take place, along with strong longitudinal flow of fluid in the channels between the teeth. Then, the third stage of compression as described above can take place in areas 58*c* for high, piston-like compression and efficient pumping.

As a significant advantage of pumps of this invention which exhibit a low angle of wrap and a number of teeth typically in excess of 40 per gear (at least for outer gear 50) the high compression provided in areas 58*c* does not depend upon parts of the casing, but rather the upstream end of the chamber area 58*c* is closed, the sides are closed, and the downstream end communicates with the outlet manifold. Thus the pump of this invention is capable of very high pressure pumping without depending upon strength and sealing provided by the casing, except of course at the downstream manifold area.

Figure 8:
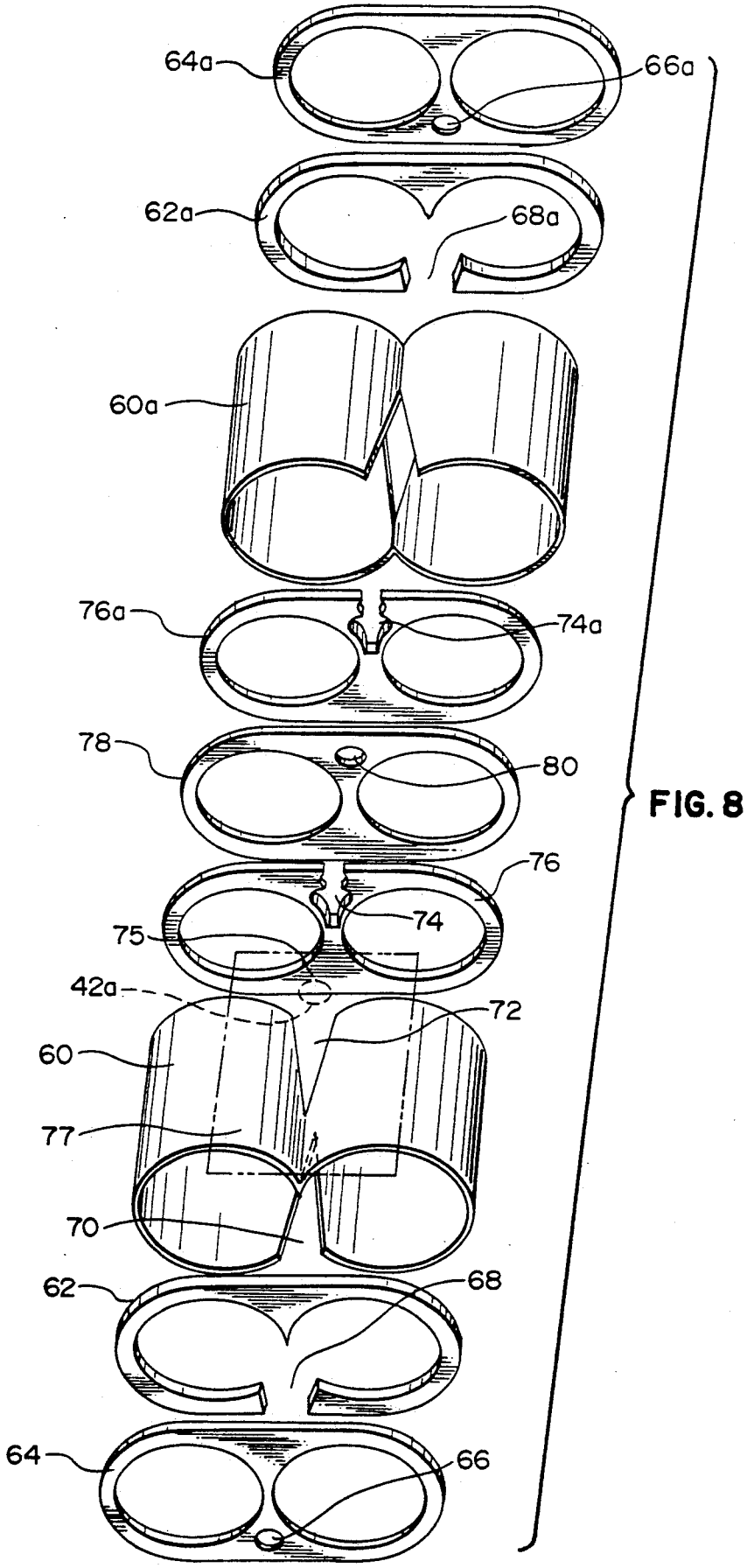
FIG. 8 is an exploded view of one embodiment of a housing for particularly the gear pump of a type similar to that of FIG. 1, and also the pump of FIG. 4.

Referring to FIG. 8, an exploded view of one design of casing for use in the helical tooth gear pump of this invention is disclosed. This particular casing design is particularly suitable for lower pressure uses and for the pumping of liquids.

Referring to FIG. 8, a perspective view is shown of one embodiment of the housing which may be used to enclose a gear pump of the type similar to that shown in FIG. 1. Additionally, the housing of FIG. 8 may be used in conjunction with other types of gear pumps as well.

Central pump housing section 60 comprises a shaped steel wall that rotatably receives a pair of meshing pump gears in a manner similar to that shown in FIG. 2. Inlet manifold plate 62 is provided at one end of pump housing section 60, being analogous to inlet manifold plate 29 of the FIG. 1 configuration. End plate 64 and manifold plate 62 define room for a rotary shaft to rotate the meshing gear teeth, or to receive ends of the gear teeth themselves. Additionally, an inlet port 66 is provided for inflowing fluid to be pumped.

The inflowing fluid passing through port 66 passes through side aperture 68 of manifold plate 62 and along the sides of the meshing gears in a tapered manifold aperture 70 which is analogous to aperture 36 in the embodiment of FIG. 1.

The pumped fluid is then carried through the chambers defined between the meshing gear teeth as the gears rotate, to be carried in the direction of the axis of rotation of the respective gears within casing 60, to be released in the vicinity of outlet manifold aperture 72, which is analogous to the manifold aperture 40 in FIG. 1. The pumped fluid passes through shaped aperture 74 of outlet manifold plate 76, with shaped aperture 74 being of the desired shape shown, which promotes the efficient transfer of fluid from the chambers defined between the rotating gear teeth, while providing good sealing as well.

Outlet manifold 42*a* is shown, similar to outlet manifold 42 in FIG. 2. Product from the outlet manifold 42*a* may pass out of aperture 75, as defined in manifold plate 77.

A corresponding inlet manifold 70 and manifold plate analogous to manifold 34 of FIG. 2 may be defined on the other side of the apparatus as shown in FIG. 2. Outlet port 75 is preferably positioned above shaped aperture 74.

Central plate 78 then defines a connection port 80, which provides connection between shaped aperture 74 of outlet manifold plate 76, and the corresponding outlet manifold plate 76*a*, having a corresponding shaped aperture 74*a*, positioned on the other side of plate 78.

Beginning with the manifold plate 76*a*, corresponding manifold parts are provided for the other set of pumping gears, so that a pair of opposed gear pumps, carried on common shafts, may be provided in a manner similar to that shown in FIGS. 1 and 2.

Specifically, casing 60*a* is provided, being shaped in a manner corresponding to casing 60 but reversed in position as shown. Beyond casing 60*a* is manifold plate 62*a*, similar to manifold plate 62, followed by end plate 64*a*, which is analogous to end plate 64. Additionally, apertures 66*a* and 68*a* are provided in a corresponding manner to apertures 66 and 68.

Another manifold plate similar to plate 77 may be provided over members 60*a*, 76*a*, and 78 in a manner analogous to manifold plate 77, to provide and define an outlet manifold for the second pump member.

Figure 9:
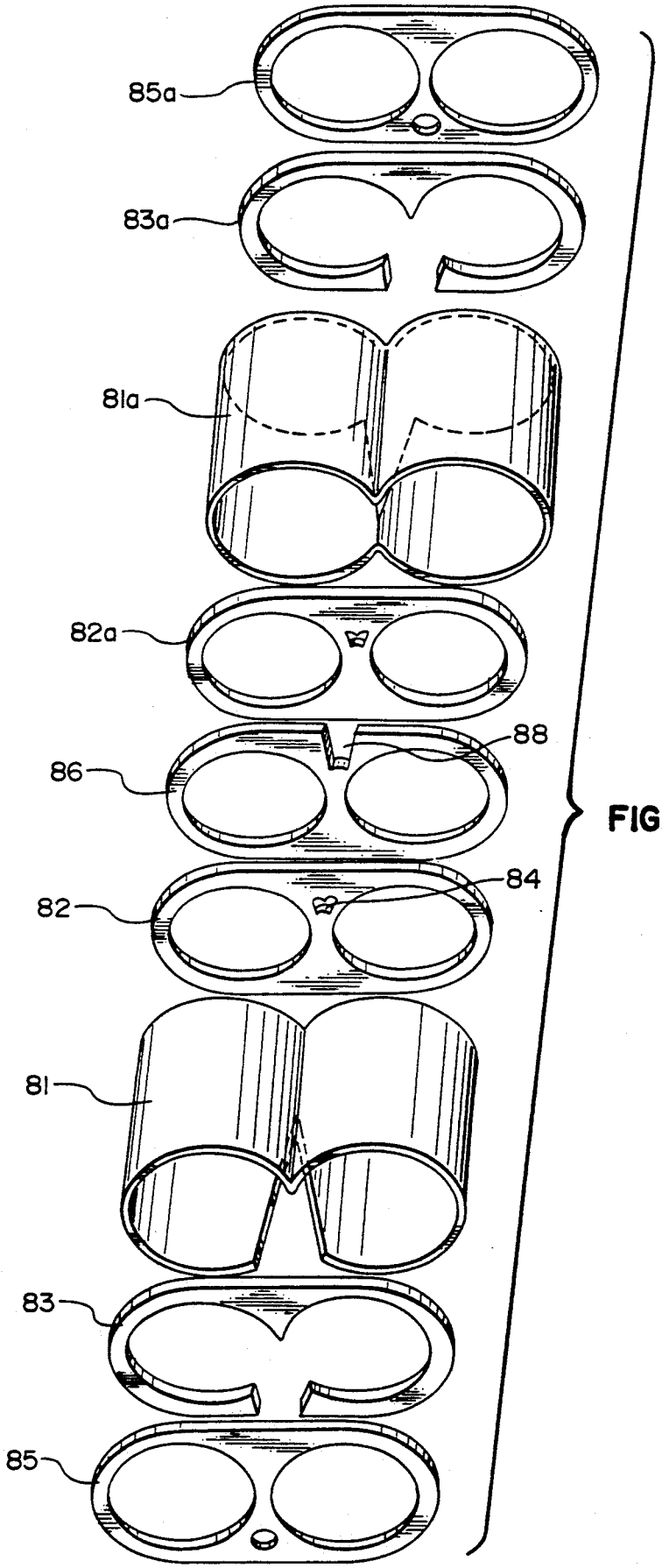
FIG. 9 is another embodiment of housing for similar pumps.

FIG. 9 discloses another embodiment of a housing for rotating, interengaging pump gears having helical gear teeth in accordance with this invention. This housing may be used for the same kind of pumps as the housing of the previous FIG. 8. Pump gear housing section 81 may be similar in function and structure to the pump gear housing 60 of FIG. 8 except that it has no outlet manifold aperture similar to aperture 72 of the previous embodiment. Manifold plates 83 and 85 may be similar to the previous embodiment in structure and function, so that the inlet of fluid to the meshing pump gears with helical teeth may be identical to the previous embodiment.

However, this particular housing may be used for high pressure pumping conditions. Reinforcing end plate 82 is provided, having a small aperture 84 to engage the ends of the fluid-carrying channels between engaging gear teeth. Manifold plate 86 is provided, defining an outlet channel 88 which provides a side exit to the high pressure fluid output. End plate 82*a* then provides a side seal to the output channel 88, and also begins a manifold chamber for a second pump assembly.

A second pump gear housing 81*a* is provided, being of a design similar to housing section 81 but reversed as shown. Sections 81 and 81*a* hold the respective rotary pump gears. Plates 83*a* and 85*a* are also provided, being identical to their corresponding counterparts 83 and 85. High pressure fluid may be taken off of the channel 88 by a desired porting or conduit arrangement.

Thus, another manifold housing is disclosed in which two gear pumps may operate off of common shafts for high pressure pumping.

Figure 10:
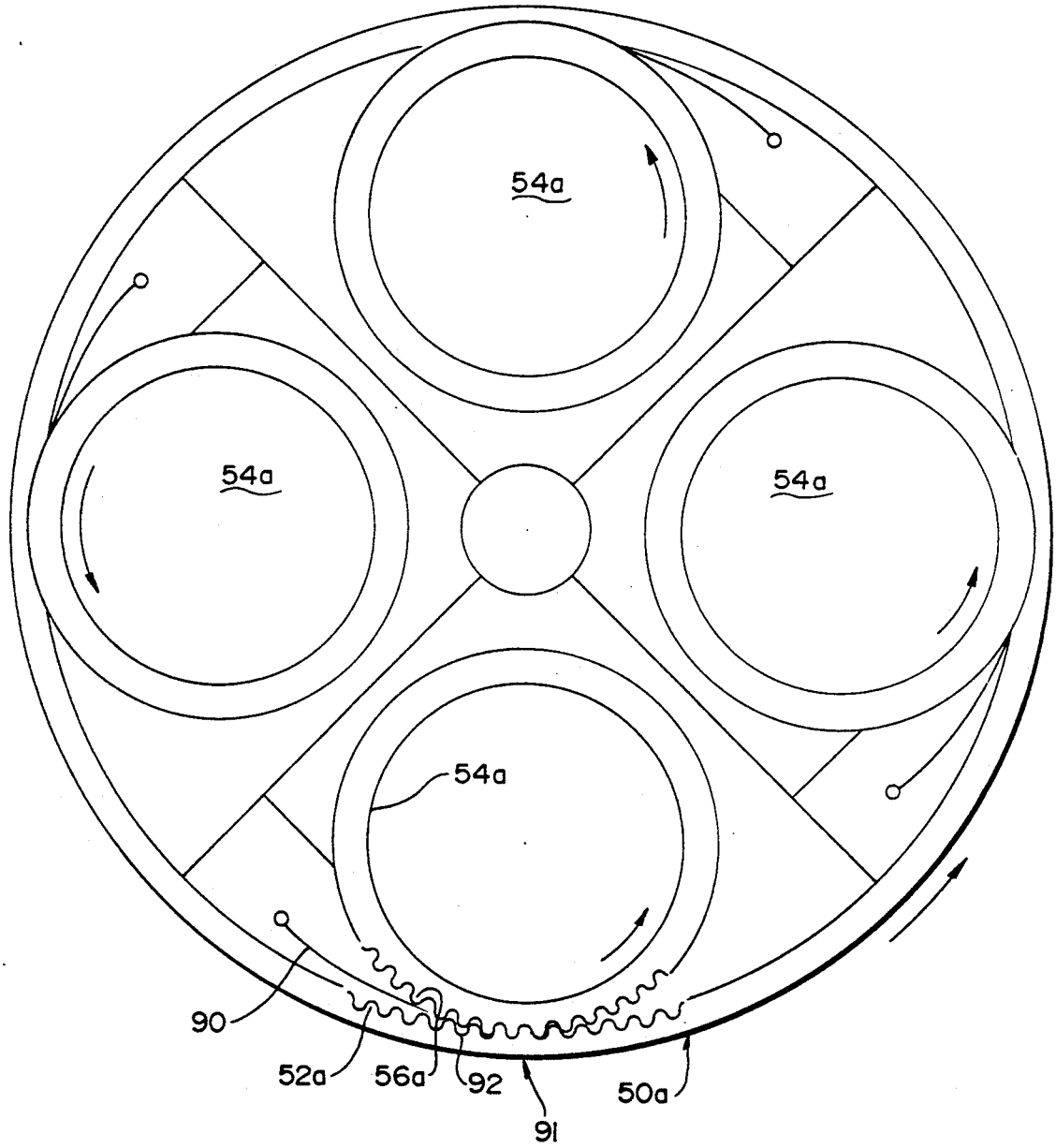
FIG. 10 is a diagrammatic, transverse, sectional view of another embodiment of the gear pump with helical teeth in accordance with this invention, being particularly adapted for use as an internal combustion engine.

FIG. 10 is a diagrammatic view of a multiple pumping system of the general type disclosed in FIGS. 6 and 7. Outer gear ring 50*a* defines a series of inwardly facing, helical teeth 52*a* which extend all the way around the gear ring, but are only shown in a short section for simplicity of disclosure. Teeth 52*a* are preferably helically disposed with an overall degree of wrap and at an angle as previously disclosed herein.

Four inner rotatable gears 54*a* are provided as well, each having teeth 56*a* (only partly showr) that are angled to mesh with the helical teeth 52*a* of the outer ring.

Thus, as any of the respective rings are rotated by a power shaft, all of the rings are rotated, with pumping action being provided at the four respective meshing areas of teeth 52*a*, 56*a*. Appropriate manifolding is provided so that this structure becomes a quadruple unit pump.

Also, if desired, such an arrangement can be a basis of an internal combustion engine in which fuel is fed into each of the areas by a fuel feed line 90, where it is compressed within the channels and pumped through the "top dead center" position 91 of the respective channels, which become analogous to automotive cylinders. This may be accomplished by designing in a recess 92 (see also FIG. 7), for example at the bottom of each channel between the respective teeth 52*a*, 56*a* so that the volume in the respective channels between the teeth does not go to zero at the "top dead center" position 91.

Then, as the gears continue to turn, the channels between the respective teeth 52*a*, 56*a* begin to expand again. If the compression at the "top dead center" position 91 is sufficient to ignite the fuel through dieseling action, power will be applied to rotate of the system by the burning gasoline in the expanding chambers, so that a rotary internal combustion engine may be provided.

Such a rotary internal combustion engine can be seen to have significant advantages, in that its operation will be very smooth, since a multitude of preferably one hundred or more individual combustions in minute chambers per revolution will take place, these chambers being the chambers defined between the meshing gear teeth. Also, under the conditions described above, the third stage compression of the respective chambers may be provided so that there is no direct contact of the burning fuel at highest compression with the housing, but only the respective gears. Also, the system runs like a diesel engine, without the need of spark plugs or the like.

The above has been offered for illustrative purposes only, and is not intended to limit the scope of the invention of this application, which is as defined in the claims below.

That which is claimed is:

1. A rotary pump which comprises a housing and at least a pair of rotatable, meshing gears positioned within said housing, the meshing gears defining teeth which extend helically in the general direction of the axis of each gear rotation, a flow inlet and a flow outlet positioned in the housing to permit fluid to flow longitudinally along the gears, generally in the direction of said axis, one of said gears defining an outer ring gear defining, in turn, its teeth on its inner periphery, at least one inner gear positioned within said outer gear and defining outwardly facing teeth that are proportioned to mesh with the inwardly facing teeth of said outer gear, whereby the meshing, helical teeth of the respective gears provide fluid-receiving chambers for the pumping of fluids from one end of the gear system to the other as the gears rotate, at least the teeth of the outer ring gear defining a total angle of wrap from end to end of the gear upon which they are carried of essentially 360 divided by twice the number of teeth on the gear, in degrees, multiplied by a number N of ½ to 3.

2. The rotary pump of claim 1 in which a plurality of inner gears are provided in meshing relation with the outer ring gear, the meshing, helical teeth of the respective gears each being connected with flow manifold means to provide and receive fluid for pumping to the respective, meshing gear teeth.

3. The rotary pump of claim 2 in which all gears present define teeth having said total angle of wrap.

4. The rotary pump of claim 2 in which at least 3 gears are positioned in side-by-side relation, providing multiple pumping sites of helically disposed teeth.

5. The rotary pump of claim 1 in which each of said gear teeth define an outer lobe having a circular, outwardly-facing cross-section perpendicular to the axis of gear rotation, said teeth being spaced by recesses of substantially circular cross section, and proportioned to receive a gear tooth from an adjacent, meshing gear, and being of essentially equal radius to the outwardly facing cross sections.

6. A rotary pump which comprises a housing, and at least a pair of rotatable, meshing gears positioned within said housing, said meshing gears defining at least 40 teeth on each gear which extend helically in the general direction of the axis of each gear rotation, and a flow inlet and flow outlet, each positioned in the housing to permit fluid to flow substantially longitudinally between said meshing gears, the helically extending teeth of said meshing gears each defining a total angle of wrap from end to end of the gear upon which they are carried of 360 divided by twice the number of teeth on the gear, in degrees, multiplied by a number N of one half to three, each of said gear teeth defining an outer lobe having a circular, outwardly-facing cross-section perpendicular to the axis of gear rotation, said teeth being spaced by recesses of substantially circular cross section and proportioned to receive a gear tooth from an adjacent, meshing gear, and being of essentially equal radius to the outwardly facing cross sections, said meshing teeth defining chambers between them which become spontaneously sealed at both sides while defining a diminishing volume as said meshing gears rotate, to provide ultra high compression to fluid within said chambers.

7. The rotary pump of claim 6 in which N is 0.8 to 2.

8. The rotary pump of claim 6 in which said gears are of essentially equal size and number of teeth.

9. The rotary pump of claim 6 in which said gears define 100 to 500 teeth.

10. The rotary pump of claim 6 in which one of said gears defines an outer ring gear defining, in turn, its teeth on its inner periphery, at least one inner gear positioned within said outer gear and defining outwardly facing teeth that are proportioned to match with the inwardly facing teeth of said outer gear, the teeth of said gears being helically disposed and capable of matching with each other to provide fluid-receiving chambers for the pumping of fluids from one end of the gear system to the other as the gears rotate.

11. The gear pump of claim 10 in which a plurality of inner gears are provided in meshing relation with the outer ring gear, the meshing, helical teeth of the respective gears each being equipped with flow manifold means to provide and receive fluid for pumping to the respective, meshing gear teeth.

12. The rotary pump of claim 6 in which said teeth define a helical angle of $\pi$ D/2TL where D is the diameter of the gear, $\pi$ is the known constant of essentially 3.14159, T is the number of teeth per gear, and L is the length of the gear, multiplied by a number N of ½ to 3, said helical angle being expressed as a ratio of the circumferential displacement of each gear tooth per unit of axial displacement of the gear tooth.

13. A rotary pump which comprises a housing, and at least a pair of rotatable, meshing gears positioned within said housing, said meshing gears defining teeth which extend helically in the general direction of the axis of each gear rotation, and a flow inlet and flow outlet, each positioned in the housing to permit fluid to flow substantially longitudinally between said meshing gears, the helically extending teeth of at least one of said meshing gears each defining a total angle of wrap from end to end of the gear upon which they are carried of 360 divided by twice the number of teeth on the gear, in degrees, multiplied by a number N of ½ to 3.

14. The rotary pump of claim 13 in which N is 0.8 to 2.

15. The rotary pump of claim 13 in which said gears are of an essentially equal size and each define at least 40 teeth, each of said gear teeth defining an outer lobe having a circular, outwardly-facing cross-section perpendicular to the axis of gear rotation, said teeth being spaced by recesses of substantially circular cross section and proportioned to receive a gear tooth from an adjacent, meshing gear, and being of essentially equal radius to the outwardly facing cross sections.

16. The rotary pump of claim 15 in which said gears define from 100 to 500 teeth.

17. The rotary pump of claim 13 in which said teeth define a helical angle of $\pi$ D/2TL where D is the diameter of the gear, $\pi$ is the known constant of essentially 3.14159, T is the number of teeth per gear, and L is the length of the gear, multiplied by a number N' of ½ to 3, said helical angle being expressed as a ratio of the circumferential displacement of each gear tooth per unit of axial displacement of the gear tooth.

18. The rotary pump of claim 13 in which the helical angle of said teeth to the gear axis is no more than about 20 degrees.

19. The rotary pump of claim 13 in which the meshing teeth define chambers between them which become spontaneously sealed at both sides while defining a diminishing volume as said meshing gears rotate, to provide ultra high compression to fluid within said chambers.

20. The rotary pump of claim 19 which is used as an internal combustion engine.

21. The rotary pump of claim 13 for pumping of liquid, in which said gears each carry from 6 to 500 teeth per gear.

22. The rotary pump of claim 13 which is used as a vacuum pump, in which said gears each carry from 2 to 10 teeth per gear.

* * * * *